US007984938B2

(12) United States Patent
Tanimoto et al.

(10) Patent No.: US 7,984,938 B2
(45) Date of Patent: Jul. 26, 2011

(54) DOOR HANDLE DEVICE FOR VEHICLE

(75) Inventors: Tetsurou Tanimoto, Anjo (JP); Koichi Nagata, Chiryu (JP); Eiji Mushiake, Chita-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 166 days.

(21) Appl. No.: 11/715,369

(22) Filed: Mar. 8, 2007

(65) Prior Publication Data

US 2007/0216175 A1 Sep. 20, 2007

(30) Foreign Application Priority Data

Mar. 16, 2006 (JP) ..... 2006-072367
Mar. 22, 2006 (JP) ..... 2006-078380

(51) Int. Cl.
*E05B 3/00* (2006.01)
*E05B 65/10* (2006.01)

(52) U.S. Cl. ..... 292/336.3; 292/92; 292/DIG. 65; 70/262; 70/266; 340/425.5

(58) Field of Classification Search ..... 292/336.3, 292/92, DIG. 65; 340/5.72, 425.5; 341/34; 70/262–266
See application file for complete search history.

(56) References Cited

U.S. PATENT DOCUMENTS 5,880,538 A * 3/1999 Schulz ..... 307/109
6,075,294 A * 6/2000 Van den Boom et al. ... 307/10.1
6,774,789 B2 * 8/2004 Inaba et al. ..... 340/541
6,883,840 B2 * 4/2005 Sueyoshi et al. ..... 292/336.3
2003/0107473 A1 * 6/2003 Pang et al. ..... 340/5.72
2003/0122556 A1 * 7/2003 Sueyoshi et al. ..... 324/686
2004/0125545 A1 * 7/2004 Kobayashi et al. ..... 361/600
2004/0251695 A1 * 12/2004 Kobayashi et al. ..... 292/216
2004/0262139 A1 * 12/2004 Ieda et al. ..... 200/341
2005/0006909 A1 * 1/2005 Tanimoto et al. ..... 292/201
2005/0236846 A1 * 10/2005 Hidaka et al. ..... 292/216
2007/0200369 A1 8/2007 Reifenberg et al.

FOREIGN PATENT DOCUMENTS

DE 196 33 894 C2 2/1998
EP 1 306 503 A1 5/2003
EP 1465119 A1 * 10/2004
JP 2002-295094 A 10/2002
JP 2003-221948 A 8/2003
WO WO 2006/005419 A1 1/2006

OTHER PUBLICATIONS

Extended European Search Report issued in corresponding for EP 07 10 3680 mailed Nov. 06, 2007.

* cited by examiner

*Primary Examiner* — Carlos Lugo
*Assistant Examiner* — Alyson M Merlino
(74) *Attorney, Agent, or Firm* — Buchanan Ingersoll & Rooney PC

(57) ABSTRACT

A door handle device for a vehicle includes a first handle member made of resin and formed with a housing portion which houses an electronic component and is arranged opposing to the outer panel and a second handle member covering the housing portion and assembled to the first handle member. A first connector, which protrudes in a vehicle width direction penetrating through the outer panel, is provided at an end of the first handle member. A board mounted with a control circuit connected to the electronic component is housed in the housing portion in a state where the board is connected to a terminal of the first connector and a terminal of the electronic component.

22 Claims, 9 Drawing Sheets

DOOR HANDLE DEVICE FOR VEHICLE

CROSS REFERENCE TO RELATED APPLICATIONS

This application is based on and claims priority under 35 U.S.C. §119 with respect to Japanese Patent Application No. 2006-078380 filed on Mar. 22, 2006 and Japanese Patent Application No. 2006-072367 filed on Mar. 16, 2006, the entire content of which are incorporated herein by reference.

FIELD OF THE INVENTION

The present invention relates to a door handle device for a vehicle, which is used for opening/closing a vehicle door.

BACKGROUND

Known door handles for a vehicle which are mounted on an outer panel of a door to protrude outwardly therefrom and are operated for opening/closing the door have been disclosed. Electronic components built in the door handle are connected to a control unit provided outside the door handle via a wire harness. For example, according to a door handle described in DE19633894C (column 3-5; FIG. 1), a connector 30 is provided on a tip end of an arm 11, which is provided to extend towards inside of the door relative to a door panel 40, to protrude in a longitudinal direction of a vehicle. A micro switch 53 for outputting door lock signals is provided in the door handle so as to be remotely operable. Terminals of the micro switch 53 are connected to terminals of the connector 30 by wire harnesses 18.

With the construction of the door handle for the vehicle described in DE19633894C, a board, which is mounted with a control circuit connected to electronic components such as a micro switch built in the door handle, is not provided in the door handle. Thus, the terminals of the electronic components are connected to the terminals of the connector via the wire harnesses and the electronic components have to be connected to the board provided outside the door handle through the connector, which complicates assembling operation.

A need thus exists for a door handle device, in which a connector is configured so that a board mounted with a control circuit, which is linked to electronic components built in the door handle, and which is connectable to terminals of the electronic components and to a terminal of the connector.

SUMMARY OF THE INVENTION

In light of the foregoing, the present invention provides a door handle device for a vehicle, which includes a handle outer portion provided at an outside of an outer panel of a door for the vehicle, a grip portion provided between the outer panel and the handle outer portion with a space between the grip portion and the outer panel, a rotating portion extended from a first end of the handle outer portion into the door penetrating through the outer panel and rotatably supported by a support member fixed to an inside of the outer panel, an operating portion extended from a second end of the handle outer portion into the door penetrating through the outer panel, the operating portion operating a door opening/closing mechanism, a first handle member made of resin and formed with a housing portion which houses an electronic component and is arranged opposing to the outer panel, a second handle member covering the housing portion and assembled to the first handle member, and the rotating portion and the operating portion formed at either one of the first handle member and the second handle member. The first handle member is provided with a first connector, which protrudes in a vehicle width direction penetrating through the outer panel, and a board housing portion, which houses a board mounted with a control circuit connected to the electronic component in a state where the board is connected to a terminal of the first connector and a terminal of the electronic component, and the board housing portion is covered with the second handle member in a state where the board is housed therein. The first connector and the board housing portion are formed between the rotating portion and the grip portion.

According to the present invention, on the resin made first handle member which is formed with the housing portion, the first connector is provided at the end portion of the door handle at the rotating center side so as to protrude in the vehicle width direction through the outer panel of the door and towards inside of the door. The board mounted with the control circuit which is connected to the electronic components is housed in the housing portion in a state where the board is connected to the terminal of the electronic components and the terminal of the first connector. Accordingly, because it is not necessary to connect respective terminals of the electronic components, the board and the connector via wire harnesses, assembling of the door handle per se and the assembling of the door handle to the door can be readily achieved.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Embodiments of the present invention will be explained with reference to illustrations of drawing figures as follows.

Figure 1:
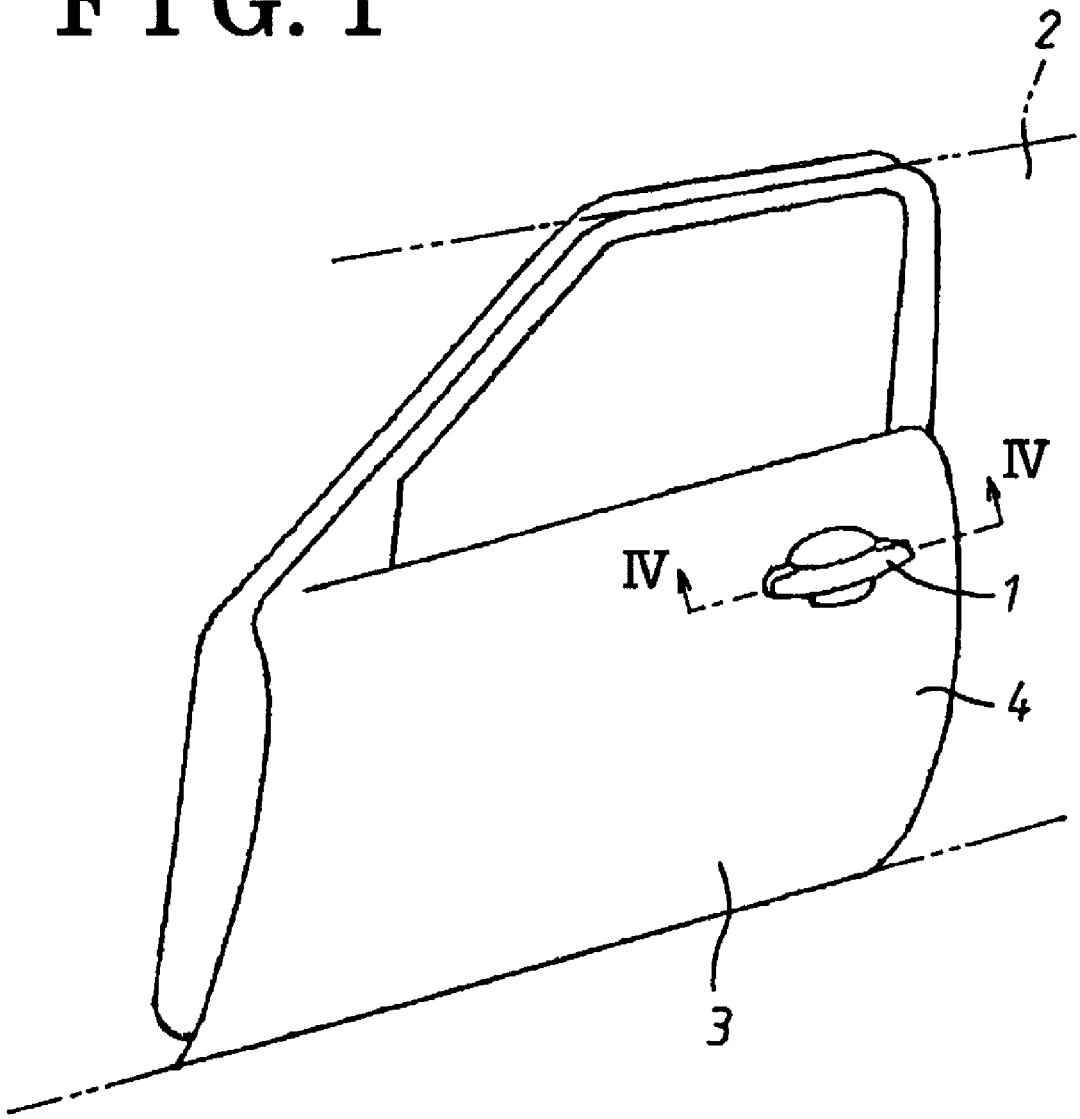
FIG. 1 is a perspective view of a door provided with a door handle device for a vehicle according to a first embodiment of the present invention.

FIG. 1 is a perspective view showing a door 3 of a vehicle 2 to which a door handle 1 for a vehicle is attached according to a first embodiment of the present invention. As shown in FIG. 1, the grip type door handle 1 which is operated for opening/closing the door 3 is attached on an outer panel 4 (e.g., made of metal) of the door 3 to protrude outwardly in a width direction of a vehicle. The door handle 1 has an approximately curved hollow structure. A first end of the door handle 1 is supported by the outer panel 4 so as to rotate and a second end of the door handle 1 includes an operating portion, which operates a door opening/closing mechanism, penetrating through the outer panel 4 to be positioned inside the door 3. Although the door 3 shown in FIG. 1 is a side door of the vehicle 2, the door handle 1 can be attached on a backdoor.

Figure 2:
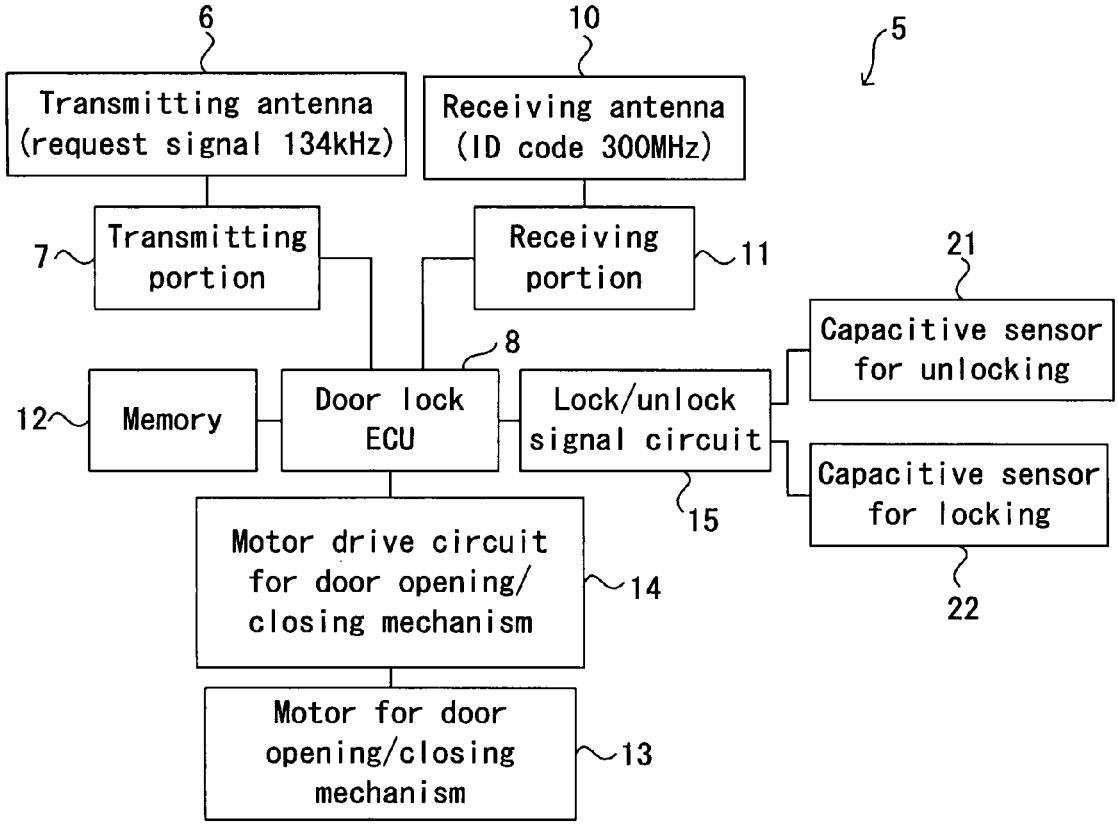
FIG. 2 is a block view showing an example of an on-vehicle transmitting and receiving device of the door handle apparatus for the vehicle.

FIG. 2 is a block view showing an example of an on-vehicle transmitting and receiving device 5 for a key less entry system also called a smart entry system serving as a door handle apparatus for the vehicle, which is for the door handle 1. As shown in FIG. 2, the on-vehicle transmitting and receiving device 5 includes a transmitting antenna 6 (i.e., serving as an electronic component) which is built in the door handle 1. The transmitting antenna 6 is connected to a transmitting portion 7 which is attached on a frame in the vicinity of the door 3 of the vehicle 2. The transmitting portion 7 is connected to a door lock ECU 8.

The door lock ECU 8 sends a request code to the transmitting portion 7, and a request signal having a frequency, for example, of 134 kHz which is formed by modulating the request code is transmitted from the transmitting antenna 6 to a portable transmitting and receiving device 9. In the vehicle 2, a receiving antenna 10 is built, for example, in a rear view mirror provided in a vehicle compartment. A signal from the portable transmitting and receiving device 9 with a frequency of for example 300 MHz, which is received by the receiving antenna 10, is demodulated at a receiving portion 11 and inputted into the door lock ECU 8. The door lock ECU 8 is connected to a memory 12. A variety of plural codes, each different from one another, such as a request code and transponder ID code, or the like, is stored in the memory 12. The memory 12 is a non-volatile memory such as EEPROM, which retains the stored information even when not powered.

The door lock ECU 8 is connected to a motor drive circuit 14 which activates a motor 13 provided on the door opening/closing mechanism. When a lock signal or an unlock signal is inputted from a lock/unlock signal circuit 15 to the door lock ECU 8, the door lock ECU 8 outputs a motor normal rotation signal or a motor reverse rotation signal to the motor drive circuit 14 respectively to lock or unlock the door opening/closing mechanism. The lock/unlock signal circuit 15 includes a lock signal circuit and an unlock signal circuit and is connected to a capacitive sensor 21 for unlocking (i.e., serving as an electric component) and a capacitive sensor 22 for locking (i.e., serving as an electric component) which are provided at the door handle 1.

Figure 3:
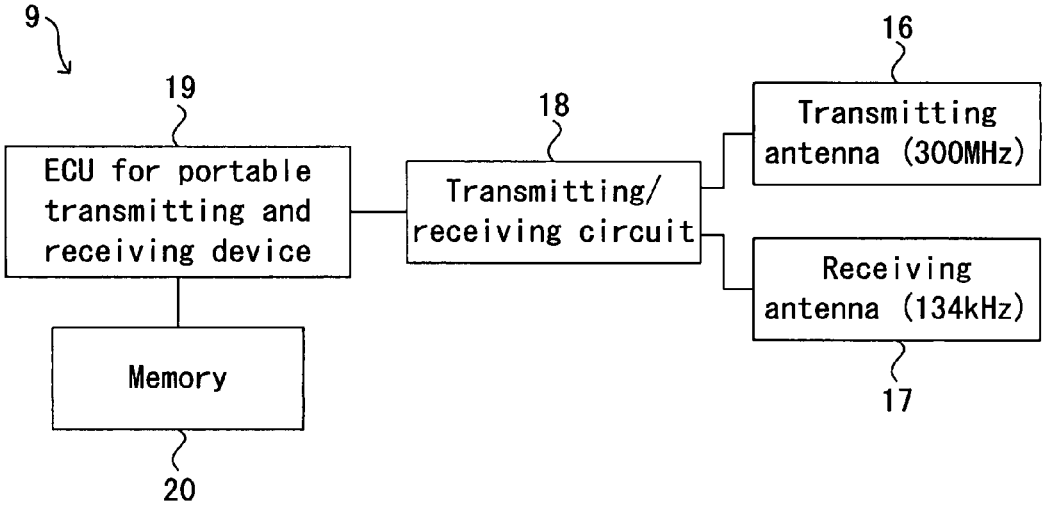
FIG. 3 is a block view showing an example of a portable transmitting and receiving device of the door handle apparatus for the vehicle.

FIG. 3 shows a block view showing an example of the portable transmitting and receiving device 9 of the smart entry system. The portable transmitting and receiving device 9 includes a transmitting antenna 16 and a receiving antenna 17. The transmitting antenna 16 and the receiving antenna 17 are connected to a transmitting/receiving circuit 18. The transmitting/receiving circuit 18 is connected to an ECU 19 for portable transmitting and receiving device. A request signal having a frequency of, for example, 134 kHz, which is transmitted from the on-vehicle transmitting and receiving device 5 and received by the receiving antenna 17 is demodulated at the transmitting/receiving circuit 18 to be inputted into the ECU 19 for portable transmitting and receiving device. The ECU 19 for portable transmitting and receiving device supplies a transponder ID code which is read out from a memory 20 to the transmitting/receiving circuit 18, the transponder ID code is modulated in the transmitting/receiving circuit 18 to be transmitted from the transmitting antenna 16 to the on-vehicle transmitting and receiving device 5 as a signal having a frequency of, for example, 300 MHz.

A request signal having a frequency of, for example, 134 kHz is constantly transmitted from the transmitting antenna 6 of the on-vehicle transmitting and receiving device 5 of the smart entry system to the portable transmitting and receiving device 9, and upon receiving the request signal, the portable transmitting and receiving device 9 replies to the on-vehicle transmitting and receiving device 5 by sending a signal having a frequency of, for example, 300 MHz which is obtained by modulating the transponder ID code. The signal having the frequency of 300 MHz which is received by the receiving antenna 10 of the on-vehicle transmitting and receiving device 5 is demodulated in the receiving portion 11 to be inputted into the door lock ECU 8. The door lock ECU 8 receives the transponder ID code which is originally from the memory 20 of the portable transmitting and receiving device 9, identifies the transponder ID code with an ID code stored in the memory 12, and activates the lock/unlock signal circuit 15 when the transponder ID code and the ID code in the memory 12 are matched. When a conductor such as a user's hand comes close to or comes in contact with the capacitive sensor 21 for unlocking or the capacitive sensor 22 for locking the door handle 1 in a state where the lock/unlock signal circuit 15 is activated, the lock/unlock signal circuit 15 outputs an unlocking signal or a locking signal, and the door lock ECU 8 locks or unlocks the door opening/closing mechanism on the basis of the unlocking signal or the locking signal.

Figure 4:
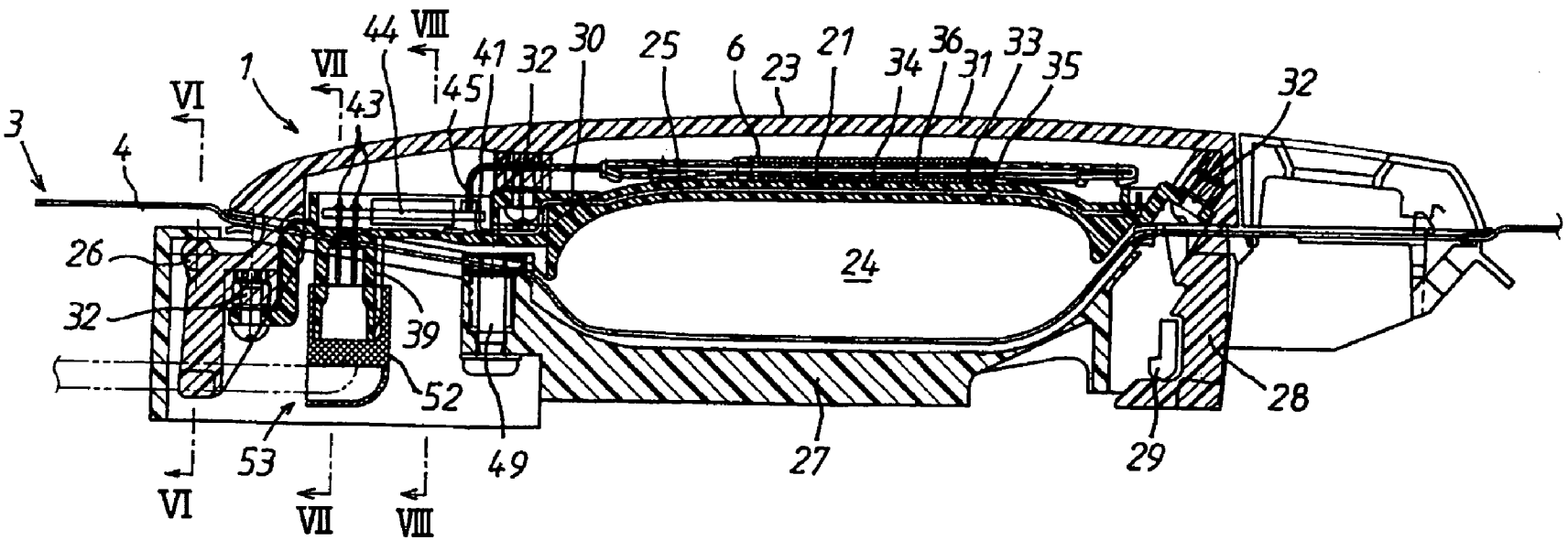
FIG. 4 is a longitudinal cross-sectional view of the door handle device taken on line IV-IV in FIG. 1 according to the first embodiment of the present invention.
Figure 6:
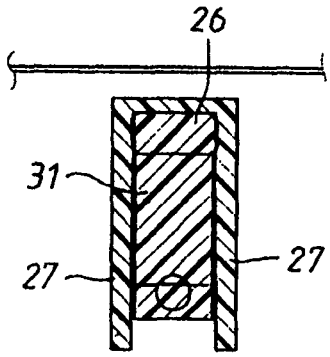
FIG. 6 is a cross-sectional view taken on line VI-VI in FIG. 4.

FIG. 4 is a cross-sectional view taken on line IV-IV of FIG. 1. As shown in FIG. 4, the door handle 1 includes a handle outer portion 23 which is positioned outside relative to an outer panel 4 of the door 3 of the vehicle 2 in a vehicle width direction. A grip portion 25 is formed on the handle outer portion 23 allowing space 24 between the outer panel 4 and the grip portion 25. A rotating portion 26 is provided on a first end of the handle outer portion 23, penetrates through the outer panel 4 to extend in the door 3, and is supported by a support portion 27 which is fixed on an inner side of the outer panel 4 by means of a screw 49 so as to rotate (shown in FIG. 6). An operating portion 28 is provided on a second end of the handle outer portion 23, penetrates through the outer panel 4 to extend in the door 3, and operates a lever 29 of the door opening/closing mechanism.

The door handle 1 is constructed by assembling a resin made first handle member 30 and a resin made second handle member 31 by screws 32 so that the first handle member 30 closes an elongated recess portion of the second handle member 31 from the outer panel 4 side. The first handle member 30 is formed with a housing portion 33, which houses electric components, facing the outer panel 4. The rotating portion 26 and the operating portion 28 are formed on the second handle member 31 which is assembled to the first handle member 30 and covers the housing portion 33. An external surface of the second handle member 31 is paint coated for appearance.

Figure 5:
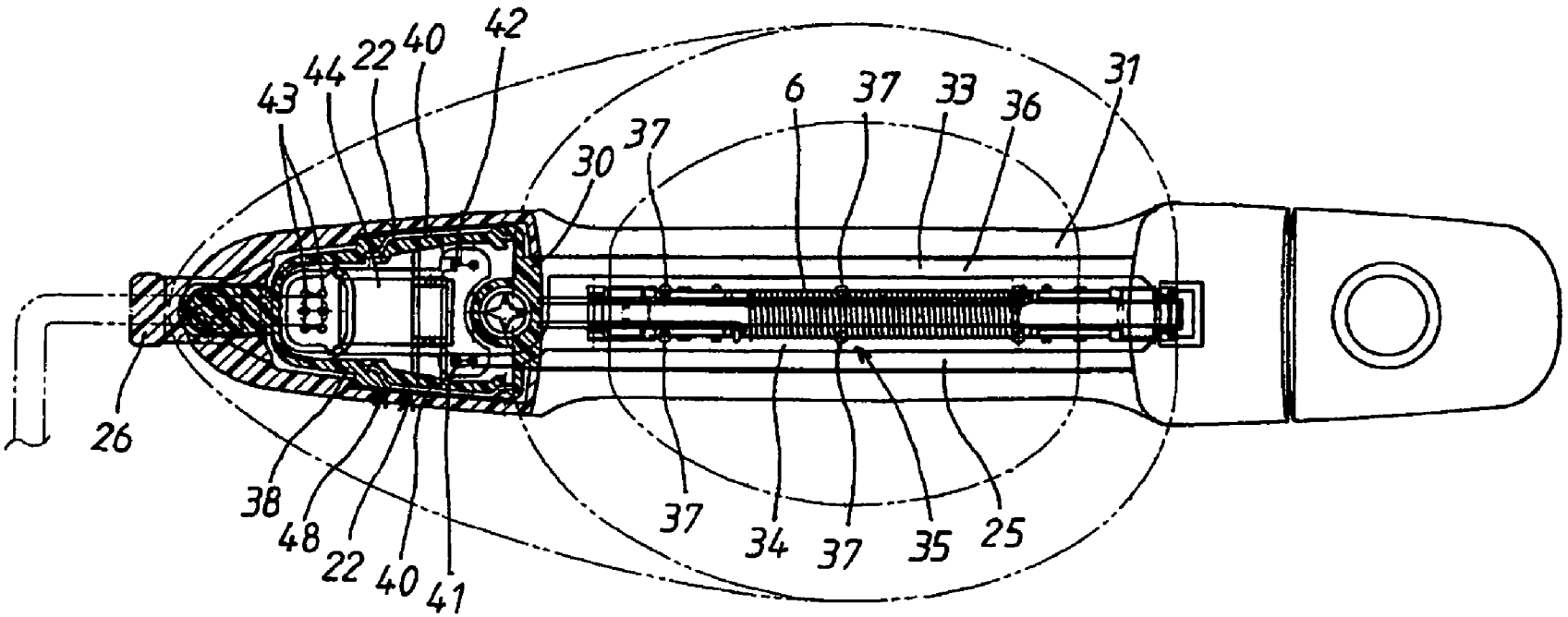
FIG. 5 is a plan view which partially shows a cross-section of the door handle.

An electrode 34 for unlocking of the capacitive sensor 21 for unlocking and the transmitting antenna 6 are housed in the housing portion 33 as electronic components. The transmitting antenna 6 is formed by winding a coil around a resin made case which houses, for example, a ferrite plate or amorphous, or the like. The housing portion 33 of the first handle member 30 is formed with a holding portion 35 which holds the electrode 34 for unlocking and the transmitting antenna 6. That is, the first handle member 30 is formed by insert molding by inserting the electrode 34 for unlocking onto a bottom wall 36 of the housing portion 33 which faces the outer panel 4. A bottom wall portion which is formed by insert molding by inserting the electrode 34 for unlocking onto the handle member 30 serves as an example of the holding portion 35 which holds the electrode 34 for unlocking in the housing portion 33. As shown in FIG. 5, in order to hold the transmitting antenna 6 in the housing portion 33, plural pillar projections 37, which include an engaging portion on each tip end thereof, are provided at the bottom wall 36 of the housing portion 33 on a bottom surface which is positioned outward relative to the electrode 34 for unlocking in a vehicle width direction to protrude along side surfaces of the transmitting antenna 6 in a longitudinal direction. The pillar projections 37 sandwich the both lateral sides of the transmitting antenna 6 and hold the transmitting antenna 6 in the housing portion 33 by engaging upper surface of the transmitting antenna 6 with an engaging portion. The pillar projections 37 are an example of the holding portion 35 which holds the transmitting antenna 6 in the housing portion 33. With the holding portion 35 which holds the electrode for unlocking, instead of insert molding the electrode 34 for unlocking into the bottom wall 36, an engaging portion which engages with the electrode 34 for unlocking to support thereof may be formed on a bottom surface of the housing portion 33.

As foregoing, the housing portion 33 houses the electrode 34 for unlocking of the capacitive sensor 21 for unlocking, which detects a change of the capacitance between the outer panel 4 and the electrode 34 for unlocking, and the electrode 34 for unlocking is supported by the bottom wall 36 by insert molding. An unlock signal circuit portion of the lock/unlock signal circuit 15 detects a change of the capacitance between the electrode 34 for unlocking and the outer panel 4 to output a door-unlocking signal.

As shown in FIGS. 4-5, the first handle member 30 includes a board housing portion 38 formed between the rotating portion 26 and the grip portion 25. A connector 39 is formed protruding from a bottom wall of the board housing portion 38 in a vehicle width direction penetrating through the outer panel 4, and extending between lateral walls of the support portion 27 in the door 3 (shown in FIG. 7). Further according to this embodiment of the present invention, the connector 39 is formed between the rotating portion 26 and the grip portion 25. An electrode 40 for locking of the capacitive sensor 22 for locking which detects a change of the capacitance between the outer panel 4 and the electrode 40 for locking is provided in the both lateral side walls of the board housing portion 38 by insert molding. In the meantime, the electrode 40 for locking which is formed as a single electrode by insert molding in the lateral walls as shown in FIG. 8. Alternatively, the electrode 40 for locking may be assembled in later process without insert molding.

Terminals (i.e., a second terminal) 41 of the electrode 34 for unlocking, terminals (i.e., a fourth terminal) 42 of the electrode 40 for locking, and terminals (i.e., a third terminal) 43 of the connector 39 are projected outwardly from a bottom wall of the board housing portion 38 in the vehicle width direction in the board housing portion 38. In order to hold a board 44 which is mounted with the lock/unlock signal circuit 15 connected to the electrode 34 for unlocking and the electrode 40 for locking in a state where the board 44 is connected to the terminals of the electrode 34 for unlocking, the electrode 40 for locking, and the connector 39, as shown in FIG. 8, plural engaging projections 46 each having an engaging portion formed at a tip end thereof are provided at a bottom surface of the board housing portion 38. By an engagement of the engaging portion of the engaging projection 46 with an engaging hole of the board 44, the board 44 is supported by the board housing portion 38. The engaging projections 46 are an example of a board holding portion 47 which holds the board 44 by the board housing portion 38.

The board 44 which is supported by the board holding portion 47 and housed in the board housing portion 38 are connected to terminals 41, 42, 43 of the electrode 34 for unlocking, the electrode 40 for locking, and the connector 39 respectively to be soldered. After housing the board 44, the board housing portion 38 is covered with the second handle member 31 in a state where the both lateral walls of the board housing portion 38 are in contact with internal walls of the both lateral walls of the second handle member 31. The first handle member 30 and the second handle member 31 are assembled via screws 32. The connector 39 is coupled to a connector 52 of a wire harness 53 connected to the transmitting portion 7.

Figure 7:
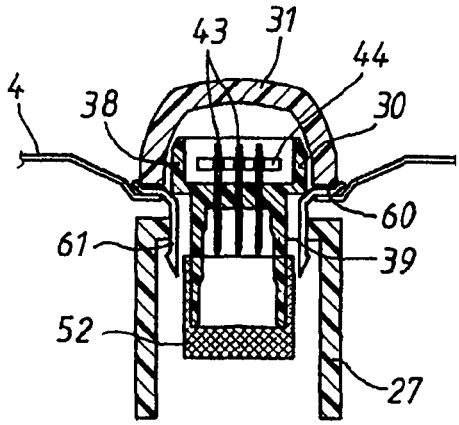
FIG. 7 is a cross-sectional view taken on line VII-VII in FIG. 4.
Figure 8:
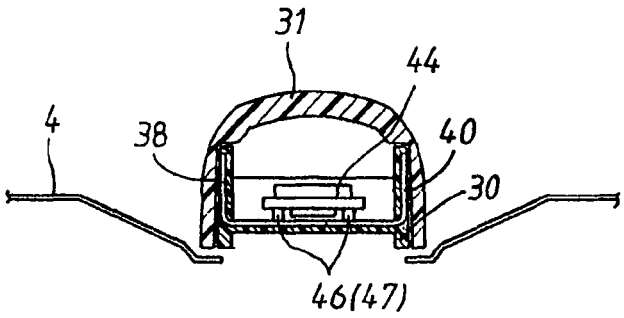
FIG. 8 is a cross-sectional view taken on line VIII-VIII in FIG. 4.

As shown in FIG. 7, a pad 60 is provided between the outer panel 4 of the door 3 and the door handle 1. The pad 60 is fixed to the outer panel 4 by inserting and engaging an engaging projection which is protruded from the pad 60 with an engagement hole formed on the outer panel 4. The pad 60 prevents the outer panel 4 from being damaged from an impact when the outer panel 4 contacts the door handle 1. The pad 60 includes a bulkhead portion 61 which extends inwardly in a vehicle width direction beyond a connecting portion of the connector 39 and the connector 52 to cover top and bottom of the connecting portion and of the connector 39, which is formed protruding from the first handle member 30, and the connector 52 coupled to the connector 39 in an assembled state. Accordingly, because the pad 60 which is provided between the outer panel 4 of the door 3 and the door handle 1 extends to cover the connector 39 which is included in the first handle member 30 and the connector 52 which is connected to the connector 39, water leaking in the door 3 is prevented from leaking into the connector 39 and the connector 52 through the connecting portion of the connector 39 and the connector 52.

Although terminals (i.e., a first terminal) 45 of the transmitting antenna 6 are connected to the board 44 and thus are connected to the transmitting portion 7 via a pattern formed on the board 44 and the connector 39 according to the first embodiment of the present invention, instead, a power supply circuit and the transmitting portion 7 may be mounted on the board 44, for example, a driver may be mounted on the board 44.

According to the first embodiment of the present invention, when a conductor such as a user's hand comes close to or comes in contact with a portion of the capacitive sensor 22 for locking the door handle 1, the lock/unlock signal circuit 15 detects a change of the capacitance between the electrode 40 for locking and the outer panel 4 to output a lock signal.

Instead of the foregoing construction, a push button switch having a point of tangency opened and closed by an operation of a push button may be provided at the door handle 1 so that the push button can be pushed from the outside and the lock signal is inputted into the door lock ECU 8 when the point of tangency is closed. In those circumstances, the push button switch is connected to an input and output circuit of the door lock ECU 8 and only an unlock signal circuit is mounted on the board 44. The capacitive sensor 22 for locking and the lock signal circuit or the push button switch serve as a lock signal transmitting means 48 for transmitting door lock signals.

As explained above, the connector 39 is provided at an end portion of the first handle member 30 at a rotation center side of the door handle 1 which is made of resin and formed with the housing portion 33 so as to protrude inwardly in the vehicle width direction relative to the outer panel 4 of the door 3 of the vehicle 2. Also, the board 44 on which the lock/unlock signal circuit (i.e., control circuit) 15 connected to the electronic components 6, 21, 22 is mounted is housed in the housing portion 33 while being connected to the connector 39 and the electronic components 6, 21, 22 via the terminals. Accordingly, because it is not necessary to use wire harnesses to connect terminals of the electronic components 6, 21, 22, the connector 39 and the board 44, assembling of the door handle 1 per se and assembling of the door handle 1 to the door 3 is readily conducted.

Although the board housing portion 38 is formed at the first handle member 30 between the rotating portion 26 of the door handle 1 and the grip portion 25 according to the first embodiment of the present invention, the board housing portion 38 may be formed at any portion of the first handle member 30.

According to the first embodiment of the present invention, because the housing portion 33 which faces the outer panel 4 of the door 3 of the vehicle 2 is formed on the first handle member 30, the electrode 34 for unlocking and the transmitting antenna 6 are housed in the housing portion 33 to be supported by the support portion 35 as a sub-assembly, the number of parts when assembling the second handle member 31 to the first handle member 30 by means of the screws 32 to cover the housing portion 33 is reduced, which facilitates the assembling process and reduces manufacturing cost. Further, the electrode 34 for unlocking and the transmitting antenna 6 are held at the first handle member 30 as an assembly without providing facilities for integrally forming the electrode 34 for unlocking and the transmitting antenna 6 with resin mold at lower manufacturing cost. Still further, because only a part of the bottom wall 36 of the housing portion 33 of the first handle member 30 is intervening between the electrode 34 for unlocking and the outer panel 4 of the door 3 of the vehicle 2, when a conductor such as a hand is inserted between the door handle 1 and the outer panel 4, the capacitance between the electrode 34 for unlocking and the outer panel 4 changes adequately so that that the conductor such as the user's hand comes close to or comes in contact with the door handle 1 can be securely detected without an erroneous operation.

Further, because the board 44 which is mounted with the unlock signal circuit and the lock signal circuit is housed in the board housing portion 38 formed at the first handle member 30 and is supported by the board support portion therein, while the board 44 is connected to the terminals of the electrode 34 for unlocking, the terminals of the electrode 40 for locking and the terminals of the transmitting antenna 6, not only to readily assemble the board 44 to the first handle member 30 in a state where the board 44 is connected to the electrode 34 for unlocking, the electrode 40 for locking, and the transmitting antenna 6 via the terminals, but also the board 44 can be supported by the first handle member 30 with low manufacturing cost along with the electrode 34 for unlocking, the electrode 40 for locking, and the transmitting antenna 6 as a sub-assembly. In case the push button switch is applied instead of the capacitive sensor 22 for locking, the board 44 which is mounted with the unlock signal circuit is housed in the board housing portion 38 while the board 44 is being connected to the terminals of the electrode 34 for unlocking and the transmitting antenna 6.

The board 44 which is at least mounted with the unlock signal circuit is connected to the terminals 43 of the connector 39 which is integrally provided at the first handle member 30, the board 44 can be readily assembled to the first handle member 30.

As shown in the first embodiment of the present invention, with the construction where the lock signal transmitting means 48, for outputting the door lock signal to the door handle 1, is provided along with the unlock capacitive sensor 21 for outputting the door unlock signal to the door handle 1, the vehicle door can be securely locked or unlocked by individually confirming each locking and unlocking intention.

Further, in case the resin made first handle member 30 is formed by insert molding by inserting the electrode 34 for unlocking into the first handle member 30 in order to hold the electrode 34 for unlocking at the housing portion 33, because a layer of the resin intervening between the electrode 34 for unlocking and the outer panel 4 of the door 3 of the vehicle 2 can be formed evenly in a predetermined thickness, variations in the sensitivity of the capacitive sensor 21 for unlocking can be reduced.

Figure 9:
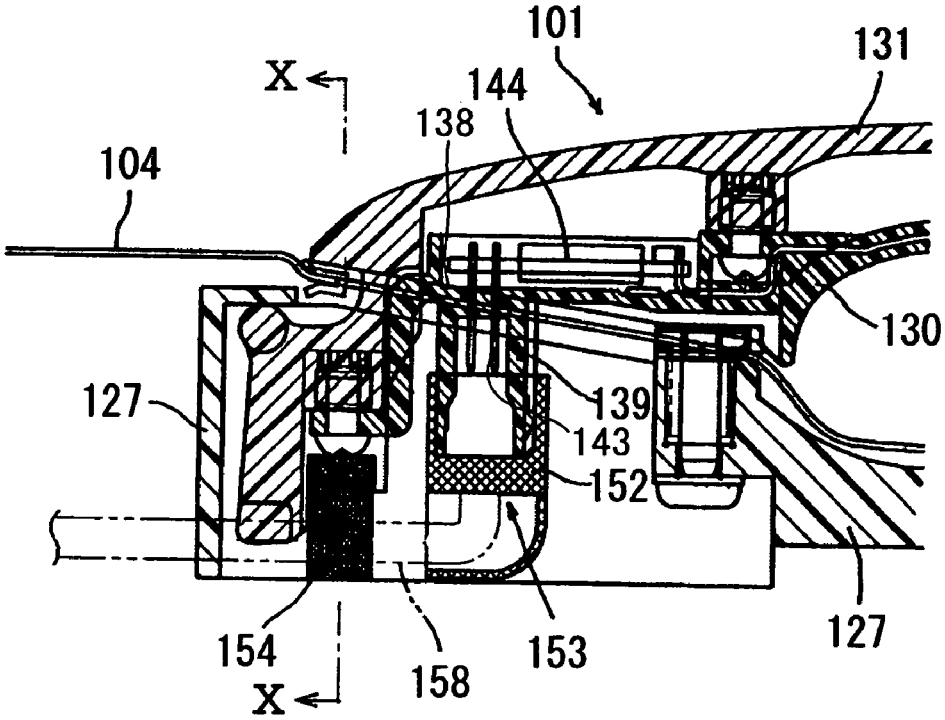
FIG. 9 is a partial longitudinal cross-sectional view of a rotating side end portion of a door handle device according to a second embodiment of the present invention.
Figure 10:
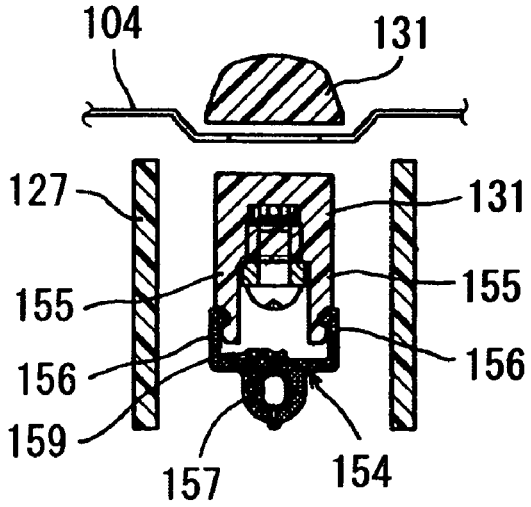
FIG. 10 is a cross-sectional view taken on line X-X in FIG. 9.

A second embodiment of a door handle device for a vehicle will be explained with reference to FIGS. 9-10 as follows. Features similar to those in the first embodiment are identified by the same reference numeral, except preceded by a "1". As shown in FIGS. 9-10, according to the construction of the second embodiment, a wire harness 153 having a connector 152 which is coupled to another connector 139 provided on a first handle member 130 is supported by a support member 154 which is fixed on a second handle member 131. In other words, at a rotating end side of a door handle 101 of an elongated recess portion of the second handle member 131 closed by the first handle member 130, an engaging groove is formed on each of external side surfaces of the both side walls 155 of the second handle member 131 protruding inwardly in the vehicle width direction. The engaging groove formed on the side wall 155 is configured to engage with an engaging craw formed to protrude inwards on each of inner sides of both of leg portions 156 of the support member 154 to fix the support member 154 to the second handle member 131. An annular support portion 157 which can be divided in part is formed between the leg portions 156 of the support member 154. When a wire portion 158 of the wire harness 153 fits in the annular support portion 157, connection portions 159 provided at a divided portion of the support portion 157 are connected, and the wire harness 153 is supported by the support member 154 which is fixed to the second handle member 131. The support member 154 which supports the wire harness 153 may be fixed to the first handle member 130.

Accordingly, because the wire harness 153 which includes the connector 152 coupled to the connector 139 provided at the first handle member 130 is supported by the support portion 157 provided at the first and second handle members 130, 131, upon the rotation of the door handle 101, the connector 139 and the connector 152 rotate together, which prevents the separation of the connector 139 and the connector 152 due to unreasonable force.

According to the second embodiment of the present invention, the first handle member 130 is formed by insert molding by penetrating terminals 143 of the connector 139 through a bottom wall of a board housing portion 138 in a vehicle width direction. Instead of the foregoing construction, a resin made terminal holding body through which the terminals 143 of the connector 139 penetrate may be formed separately, and by securing the separate terminal holding body to the bottom wall of the board housing portion 138 so that the terminal holding body closes an opening formed on the bottom wall of the board housing portion 138, the terminals 143 of the connector 139 may be formed penetrating through the bottom wall of the board housing portion 138 in the vehicle width direction.

Figure 11:
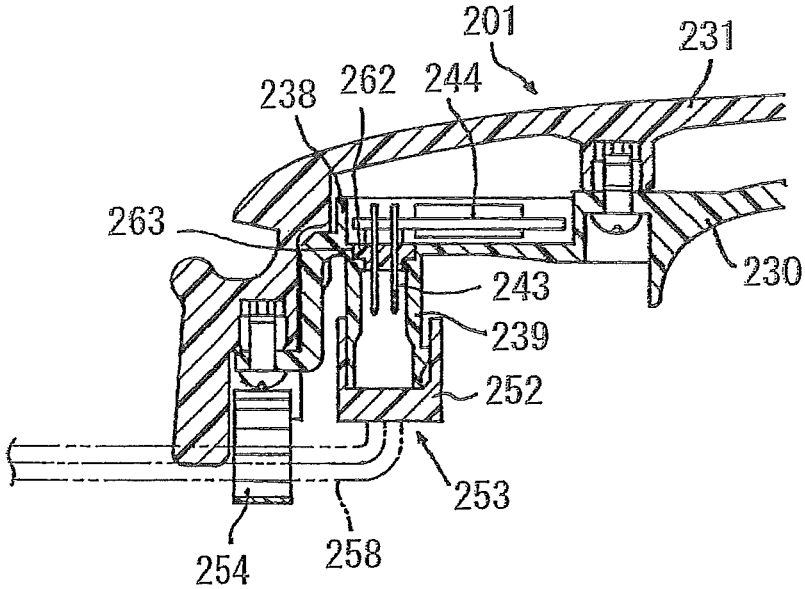
FIG. 11 is a view showing an example where a resin-made terminal holding body, which is formed by insert molding by penetrating terminals of a connector therethrough, is fixed on a bottom wall of a board housing portion.

As shown in an example illustrated in FIG. 11, a resin made terminal holding body 262 which is formed by insert molding by providing terminals 243 of a connector 239 penetrating therethrough. The terminal holding body 262 is provided at a periphery portion of a stepped portion of an opening 263 having the stepped portion formed on a bottom wall of a board housing portion 238 to close the opening 263, and is fixed thereon with adhesive agent. Other features shown in FIG. 11 which are similar to those in earlier described embodiments are identified by the same reference numeral, except preceded by a "2".

Figure 12:
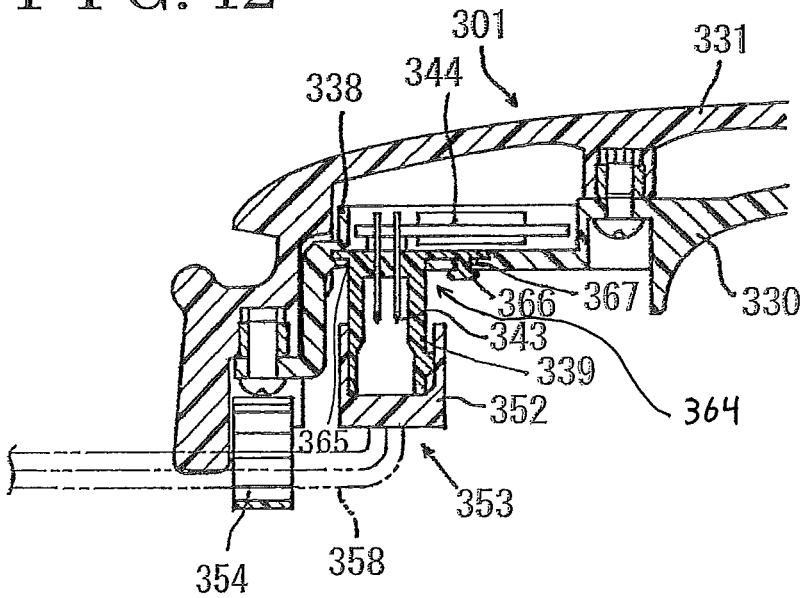
FIG. 12 is a view showing another example that a resin-made terminal holding body, which is formed by insert molding by penetrating terminals of a connector therethrough, is fixed on a bottom wall of a board housing portion.

As shown in an example illustrated in FIG. 12, a connector portion 364 serving as a terminal holding portion, which is made of thermoplastic resin and formed by insert molding by penetrating terminals 343 of a connector 339 therethrough, is housed in a board housing portion 338 to close an opening 365 having a stepped portion which is formed on a bottom wall of the board housing portion 338. Further, a first end of the connector portion 364 is provided in and engaged with a lateral groove recessed on a stepped side wall of the opening 365 having the stepped portion, a protrusion 366 formed on a second end of the connector portion 364 fits in a hole 367 pierced on the bottom wall of the board housing portion 338, and a tip end portion of the protrusion 366 is deformed by heat treatment and applied pressure to have larger diameter, and accordingly, the connector portion 364 is fixed on the bottom wall of the board housing portion 338. Other features shown in FIG. 12 which are similar to those in the earlier described embodiments are identified by the same reference numeral, except preceded by a "3".

A third embodiment of the present invention will be explained with reference to FIGS. 13-15 as follows. Features similar to those in the earlier described embodiments are identified by the same reference numeral, except preceded by a "4". According to the third embodiment of the present invention, an external surface of a second handle member 431 is plated with metal whereas the second handle member 31 of the first embodiment is paint coated. Thus, the construction of a portion of a capacitive sensor 422 for locking of the third embodiment is different from the construction according to the first embodiment. The construction of the capacitive sensor 422 for locking will be explained according to the third embodiment and explanations for common constructions will not be repeated.

When the both side walls of the board housing portion 438 in which the electrode 440 for locking of the capacitive sensor 422 for locking is inserted by insert molding are covered with the second handle member 431 which is plated with the metal on an external surface thereof in a state where the side walls of the board housing portion 438 are in contact with inside of the side walls of the second handle member 431, the capacitance between the electrode 440 for locking and the outer panel 404 does not change even when a user's hand comes close to or comes in contact with a portion of the door handle 401 provided with the capacitive sensor 433 for locking.

Figure 13:
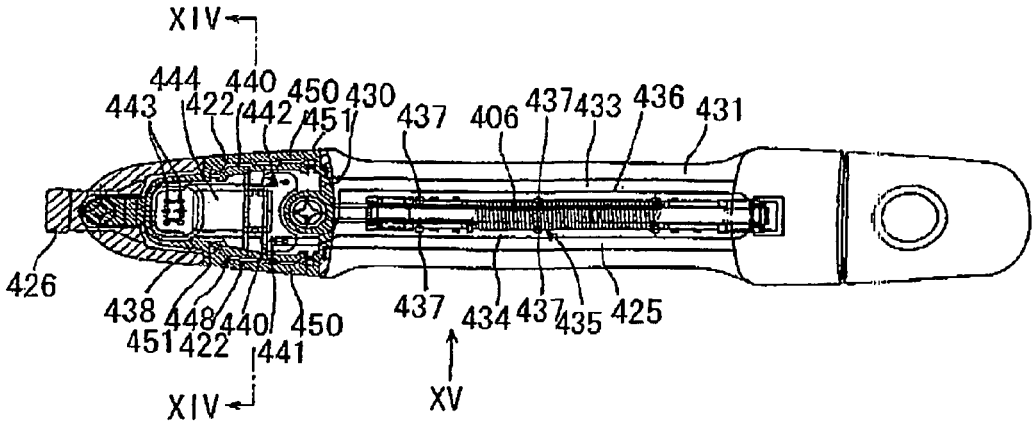
FIG. 13 is a plane view partially showing a cross-section of a part of a door handle device according to a third embodiment of the present invention.
Figure 14:
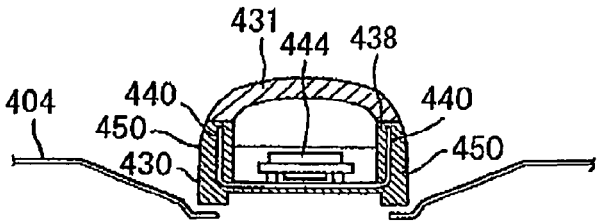
FIG. 14 is a cross sectional view taken on line XIV-XIV in FIG. 13.
Figure 15:
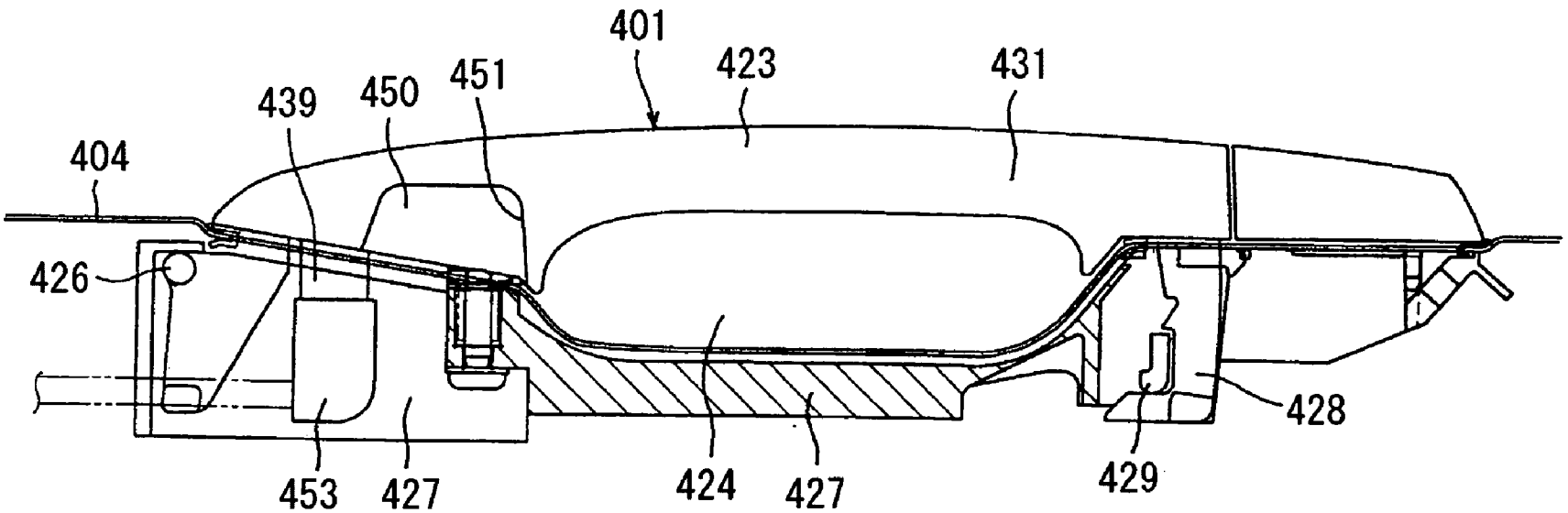
FIG. 15 is a view viewing from a direction of XV in FIG. 13.

In light of the foregoing, according to the third embodiment of the present invention, as shown in FIGS. 13-15, a portion where an electrode 440 for locking inserted in a board housing portion 438 of a first handle member 430 is overhung outward to form an overhang portion 450. In this case, the electrode 440 for locking may be assembled in a later process without the insert molding process. A second handle member 431 is provided with a recess 451 at a portion corresponding to the overhand portion 450. When the first handle member 430 and the second handle member 431 are assembled, the overhang portion 450 fits into the recess 451 so that an external surface of the overhang portion 450 and an external surface of the second handle member 431 form a single level surface. Accordingly, in the foregoing construction, when a conductor such as a user's hand comes close to or comes in contact with a portion of the door handle 401 provided with a capacitive sensor 422 for locking, the lock signal circuit of the lock/unlock signal circuit detects a change of the capacitance between an electrode 440 for locking and the outer panel 404 to output the lock signal.

In light of the foregoing, according to the third embodiment of the present invention, as shown in FIGS. 13-15, a portion where an electrode 440 for locking inserted in a board housing portion 438 of a first handle member 430 is overhung outward to form an overhang portion 450. In this case, the electrode 440 for locking may be assembled in a later process without the insert molding process. A second handle member 431 is provided with a recess 451 at a portion corresponding to the overhand portion 450. When the first handle member 430 and the second handle member 431 are assembled, the overhang portion 450 fits into the recess 451 so that an external surface of the overhang portion 450 and an external surface of the second handle member 431 form a single level surface. Accordingly, in the foregoing construction, when a conductor such as a user's hand comes close to or comes in contact with a portion of the door handle 1 provided with a capacitive sensor 22 for locking, the lock signal circuit of the lock/unlock signal circuit 15 detects a change of the capacitance between an electrode 440 for locking and the outer panel 404 to output the lock signal.

According to the embodiment of the present invention, on the resin made first handle member which is formed with the housing portion, the first connector is provided at the end portion of the door handle at the rotating center side so as to protrude in the vehicle width direction through the outer panel of the door and towards inside of the door. The board mounted with the control circuit which is connected to the electronic components is housed in the housing portion in a state where the board is connected to the terminal of the electronic components and the terminal of the first connector. Accordingly, because it is not necessary to connect respective terminal of the electronic components, the board and the connector via wire harnesses, assembling of the door handle per se and the assembling of the door handle to the door can be readily achieved.

According to the embodiment of the present invention, because the wire harness which includes the second connector coupled to the first connector provided at the first handle member is supported by the support portion which is provided at either one of the first and second handle members, the first and second connectors are rotated together when the door handle is rotated, which prevents the first and second connectors from being detached from each other due to unreasonable unbalanced force.

According to the embodiment of the present invention, because the pad which intervenes between the outer panel of the door and the door handle extends to cover the first connector provided at the first handle member and the second connector connected to the first connector and the connecting portion thereof, the water leaking in the door is prevented from leaking in the connector through the connecting portion.

According to the embodiment of the present invention, because the pad covers top and bottom of the first connector and the second connector connected to the first connector and the connecting portion thereof, the water leaking in the door is prevented from leaking in the connector through the connecting portion by a simple construction.

According to the embodiment of the present invention, because the housing portion which faces the outer panel of the door of the vehicle is formed at the first handle member and the electrode for unlocking and the antenna are housed in the housing portion to be held by the holding portion as the sub assembly, the number of parts when the second handle member is assembled to the first handle member while covering the housing portion is reduced, the assembling is readily performed, and the manufacturing cost is reduced. Further, without providing additional facilities for integrally forming the electrode for unlocking and the antenna by molding resin, the electrode for unlocking and the antenna can be held at the housing portion of the first handle member as the sub assembly at low manufacturing cost. Further, because only the bottom wall of the housing portion of the first handle member is intervened between the electrode for unlocking and the outer panel of the vehicle door, when a conductor such as a user's hand is inserted between the door handle and the outer panel, the capacitance between the electrode for unlocking and the outer panel changes adequately to securely detect that the conductor such as the user's hand comes close to or comes in contact with the door handle without errors.

According to the embodiment of the present invention, because the board is connected to the terminal of the antenna and the electrode for unlocking when the board mounted with the unlock signal circuit is housed in the board housing portion formed at the first handle member and held by the board holding portion, the board can be readily assembled to the first handle member while connected to the terminal of the antenna and the electrode for unlocking. In addition, along with the electrode for unlocking and the antenna, the board can be supported by the first handle member as the sub assembly at lower manufacturing cost.

According to the embodiment of the present invention, the board mounted with the unlock signal circuit is connected to the terminal of the first connector which is integrally provided at the first handle member, the board can be readily assembled to the first handle member.

According to the embodiment of the present invention, because the lock signal transmitting means for outputting the door lock signal is provided at the door handle, the vehicle door can be securely locked and unlocked by confirming individual locking and unlocking intention.

According to the embodiment of the present invention, the electrode for locking is provided at the first handle member and the board mounted with the unlock signal circuit and the lock signal circuit is connected to the terminal of the electrode for locking to be held by the board housing portion. Accordingly, the board can be readily assembled to the first handle member while being connected to the terminal of the electrode for locking, and along with the electrode for unlocking, the antenna and the board the electrode for locking is supported by the first handle member as the sub assembly with low cost.

According to the embodiment of the present invention, the electrode for locking is provided at the first handle member and the board mounted with the unlock signal circuit and the lock signal circuit is connected to the terminal of the electrode for locking to be held by the board housing portion. Accordingly, the board can be readily assembled to the first handle member while being connected to the terminal of the electrode for locking, and along with the electrode for unlocking, the antenna and the board the electrode for locking is supported by the first handle member as the sub assembly with low cost.

According to the embodiment of the present invention, the resin made first handle member is formed by insert molding by inserting the electrode for unlocking thereto. Accordingly, because the resin layer intervened between the electrode for unlocking and the outer panel of the vehicle door can be formed thin and evenly in a predetermined thickness, the variations in the sensitivity of the capacitance sensor for unlocking can be reduced to enhance the level of sensitivity.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle device for a vehicle, comprising:

a grip portion made of resin and formed with a housing portion which houses an electrode and is provided between an outer panel of a door and a handle outer portion with a space between the grip portion and the outer panel, the grip portion arranged opposing to the outer panel;

the handle outer portion provided at an outside of the door for the vehicle and covering the housing portion and assembled to the grip portion;

a rotating portion extended from a first end of the handle outer portion into the door penetrating through the outer panel and rotatably supported by a support member fixed to an inside of the outer panel;

an operating portion extended from a second end of the handle outer portion into the door penetrating through the outer panel, the operating portion operating a door opening/closing mechanism;

the rotating portion and the operating portion formed at the handle outer portion; wherein the grip portion is provided with a first connector, which protrudes in a vehicle width direction penetrating through the outer panel, and a board housing portion, which houses a board mounted with a control circuit connected to the electrode in a state where the board is connected to a terminal of the first connector and a terminal of the electrode, and the board housing portion is covered with the handle outer portion in a state where the board is housed therein; and wherein the first connector, the board housing portion and the board are positioned between the rotating portion and an end of the grip portion closest to the rotating portion considered with reference to a longitudinal direction of the vehicle.

2. The door handle device for the vehicle according to claim 1, further comprising:

a support portion which supports a wire harness having a second connector which is coupled to the first connector, the support portion being provided at either one of the grip portion and the handle outer portion.

3. The door handle device for the vehicle according to claim 1, further comprising:

a pad provided between the outer panel of the door and at least one of the handle outer portion and the grip portion, and extending so as to cover the first connector and a second connector connected to the first connector.

4. The door handle device for the vehicle according to claim 2, further comprising:

a pad provided between the outer panel of the door and at least one of the handle outer portion and the grip portion, and extending so as to cover the first connector and the second connector connected to the first connector.

5. The door handle device for the vehicle according to claim 3, wherein the pad covers top and bottom portions of the first connector and the second connector.

6. The door handle device for the vehicle according to claim 4, wherein the pad covers top and bottom portions of the first connector and the second connector.

7. The door handle device for the vehicle according to claim 1, further comprising:

an antenna housed in the housing portion;

the electrode housed in the housing portion being positioned closer to the outer panel relative to the antenna;

an unlock signal circuit transmitting a door unlock signal on the basis of a change of the capacitance between the electrode and the outer panel; and a holding portion provided at the housing portion of the grip portion so as to hold the electrode and the antenna.

8. The door handle device for the vehicle according to claim 7, wherein the board housing portion which houses the board mounted with the unlock signal circuit and is covered with the handle outer portion is formed on the grip portion; and further comprising a board holding portion formed at the board housing portion and holding the board so that the board is connected to a first terminal of the antenna and a second terminal of the electrode.

9. The door handle device for the vehicle according to claim 8, wherein in a state where the board is housed in the board housing portion and held by the board holding portion, the first connector which is connected to the board via the terminal of the first connector is integrally formed on the grip portion.

10. The door handle device for the vehicle according to claim 7, further comprising a lock signal transmitting means for outputting a door lock signal being provided on one of the grip portion and the handle outer portion.

11. The door handle device for the vehicle according to claim 8, further comprising a lock signal transmitting means for outputting a door lock signal being provided on one of the grip portion and the handle outer portion.

12. The door handle device for the vehicle according to claim 9, further comprising a lock signal transmitting means for outputting a door lock signal being provided on one of the grip portion and the handle outer portion.

13. The door handle device for the vehicle according to claim 8, further comprising an electrode of a capacitance sensor for locking which detects a change of a capacitance between the outer panel and the electrode being provided at the board housing portion; and a lock signal circuit mounted on the board mounted with the unlock signal circuit and outputting a door lock signal on the basis of a change of the capacitance between the electrode and the outer panel; and wherein in a state where the board is housed in the board housing portion and held by the board holding portion, the board is connected to an additional terminal of the electrode.

14. The door handle device for the vehicle according to claim 9, further comprising:

an electrode of a capacitance sensor for locking which detects a change of a capacitance between the outer panel and the electrode being provided at the board housing portion; and a lock signal circuit mounted on the board mounted with the unlock signal circuit and outputting a door lock signal on the basis of a change of the capacitance between the electrode and the outer panel; and wherein in a state where the board is housed in the board housing portion and held by the board holding portion, the board is connected to a fourth terminal of the electrode.

15. The door handle device for the vehicle according to claim 7, wherein the holding portion is configured to hold the electrode at the housing portion and is formed by insert molding by inserting the electrode for unlocking into the grip portion.

16. The door handle device for the vehicle according to claim 8, wherein the holding portion is configured to hold the electrode at the housing portion and is formed by insert molding by inserting the electrode into the grip portion.

17. The door handle device for the vehicle according to claim 9, wherein the holding portion is configured to hold the electrode at the housing portion and is formed by insert molding by inserting the electrode into the grip portion.

18. The door handle device for the vehicle according to claim 10, wherein the holding portion is configured to hold the electrode for unlocking at the housing portion and is formed by insert molding by inserting the electrode into the grip portion.

19. The door handle device for the vehicle according to claim 13, wherein the holding portion is configured to hold the electrode at the housing portion and is formed by insert molding by inserting the electrode into the grip portion.

20. The door handle for the vehicle according to claim 1, wherein the entirety of the board housing portion is positioned between the rotating portion and the end of the grip portion closest to the rotating portion considered with reference to the longitudinal direction of the vehicle.

21. A door handle device for a vehicle, comprising:

a grip portion made of resin and formed with a housing portion which houses an electrode and is provided between an outer panel of a door and a handle outer portion with a space between the grip portion and the outer panel, the grip portion arranged in opposition to the outer panel;

the handle outer portion provided at an outside of the door for the vehicle and covering the housing portion and assembled to the grip portion;

a rotating portion at a first end of the handle outer portion and penetrating through the outer panel, the rotating portion being rotatably supported by a support member fixed to an inside of the outer panel;

an operating portion at a second end of the handle outer portion and penetrating through the outer panel, the operating portion operating a door opening/closing mechanism;

the rotating portion and the operating portion being formed at the handle outer portion;

the grip portion comprising a board housing portion and a first connector protruding in a vehicle width direction penetrating through the outer panel, the board housing portion housing a board to which is mounted a control circuit connected to a terminal of the electrode, the board being connected to a terminal of the first connector, the handle outer portion covering the board housing portion;

the first connector, the board housing portion and the board being positioned between the rotating portion and an end of the grip portion closest to the rotating portion considered with reference to a longitudinal direction of the vehicle; and the board housing portion being positioned between the grip portion and the handle outer portion.

22. The door handle for the vehicle according to claim 21, wherein the entirety of the board housing portion is positioned between the rotating portion and the end of the grip portion closest to the rotating portion considered with reference to the longitudinal direction of the vehicle.

* * * * *